US010749252B1

(12) United States Patent
Lier et al.

(10) Patent No.: US 10,749,252 B1
(45) Date of Patent: Aug. 18, 2020

(54) GPS III ANTENNA PAYLOAD CONFIGURATION FOR ENHANCED PNT ACCURACY AND REDUCED HIGH POWER RISK

(71) Applicant: Lockheed Martin Corporation, Bethesda, MD (US)

(72) Inventors: Erik Lier, Lakewood, CO (US); Charles Howard Frey, Lehighton, PA (US); Mark Conrad Crews, Colorado Springs, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 119 days.

(21) Appl. No.: 16/165,984

(22) Filed: Oct. 19, 2018

(51) Int. Cl.

| | |
|---|---|
| ***H01Q 21/00*** | (2006.01) |
| ***H01Q 1/28*** | (2006.01) |
| ***H01Q 21/06*** | (2006.01) |

(52) U.S. Cl.
CPC ..... *H01Q 1/288* (2013.01); *H01Q 21/0075* (2013.01); *H01Q 21/065* (2013.01)

(58) Field of Classification Search
CPC ... H01Q 1/288; H01Q 21/0075; H01Q 21/065
See application file for complete search history.

*Primary Examiner* — Graham P Smith
(74) *Attorney, Agent, or Firm* — Morgan, Lewis & Bockius LLP

(57) ABSTRACT

An antenna array for a global positioning system (GPS) includes a first antenna element and a number of second antenna elements. The antenna array is placed at a location on a spacecraft that is above the center of gravity of the spacecraft. The first antenna element is located at the center of the antenna array and is surrounded by the second antenna elements. The first antenna element can produce a beam with a predefined null-to-null beamwidth, and the second antenna elements can form a multi-beam phased array.

20 Claims, 12 Drawing Sheets

GPS III ANTENNA PAYLOAD CONFIGURATION FOR ENHANCED PNT ACCURACY AND REDUCED HIGH POWER RISK

STATEMENT REGARDING FEDERALLY SPONSORED RESEARCH OR DEVELOPMENT

Not applicable

FIELD OF THE INVENTION

The present invention generally relates to antennas, and more particularly, to a global positioning system (GPS) antenna payload configuration for enhanced positioning, navigation and timing (PNT) accuracy and reduced high power risk.

BACKGROUND

Future global positioning system (GPS) spacecraft employ three different L-band antennas including earth coverage (EC), military earth coverage (MEC) and regional military protection (RMP) antennas to broadcast the full set of GPS L-band signals. Each antenna may have a separate phase and group delay center, which can produce PNT errors if not suitably compensated. For example, during regular spacecraft yaw orbital maneuvers, required to reduce peak-to-peak thermal variations, MEC and RMP phase and group delay centers can rotate about the EC phase center creating an additional source of PNT errors for MEC and RMP users.

The existing GPS helix antenna arrays used for EC, MEC, and RMP transmit substantially high average continuous wave (CW) powers that are typically greater than 300 W CW per antenna. Thus, these tapered helix antennas are susceptible to high-power multipaction creating single-point failure risks. The EC antenna is particularly vulnerable to multipaction due to higher powers. The existing GPS EC antenna elements are interleaved with Ultra High Frequency (UHF) crosslink antennas and the MEC antenna elements are in close proximity to the UHF antenna. These close proximities increase the risk for passive intermodulation (PIM) in and near the antennas due to high signal strength from both UHF and L-band signals. Further, the existing GPS EC antenna L1 and/or L2 patterns have angular suck-outs (nulls) toward the space service volume (SSV) at about ±23.5° and/or ±26°, which diminishes transmitted signal power to geosynchronous satellite SSV users.

SUMMARY

According to various aspects of the subject technology, systems and configurations are disclosed for providing a global positioning system (GPS) antenna payload configuration for enhanced positioning, navigation and timing (PNT) accuracy and reduced high power risk. In one or more aspects, the GPS antenna payload configuration of the subject technology can reduce the PNT error and the risk for multipaction and passive intermodulation (PIM).

In one or more aspects, an antenna array for a global positioning system (GPS) includes a first antenna element and a number of second antenna elements. The antenna array is placed at a location on the spacecraft nadir antenna deck that is above the center of gravity of the spacecraft. The first antenna element is located at the center of the antenna array and is surrounded by the second antenna elements. The first antenna element can produce a beam with a predefined null-to-null beamwidth, and the second antenna elements can form a multi-beam phased array. In some implementations, the first antenna element can be an antenna element of the second antenna elements.

In yet other aspects, a communication satellite system includes an antenna array comprising a central antenna and a number of surrounding antennas, two or more groups of amplifiers and two or more frequency multiplexers. Each group of amplifiers includes a number of amplifiers operable at a frequency band. Each frequency multiplexer can combine amplified signals from a group of amplifiers. The antenna array is placed at a location on the spacecraft nadir antenna deck that is above the center of gravity of the spacecraft. The central antenna can produce a beam with a predefined null-to-null beamwidth, and the surrounding antennas are configured to form a multi-beam phased array.

In yet other aspects, a method of configuring a GPS antenna payload includes forming an antenna array having a central antenna and a number of surrounding antennas. The method further includes configuring the central antenna to produce a beam with a predefined null-to-null beamwidth, and configuring the surrounding antennas to form a multi-beam phased array. The antenna array is mounted at a location on the spacecraft nadir deck that is above the center of gravity of the spacecraft.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

Figure 1:
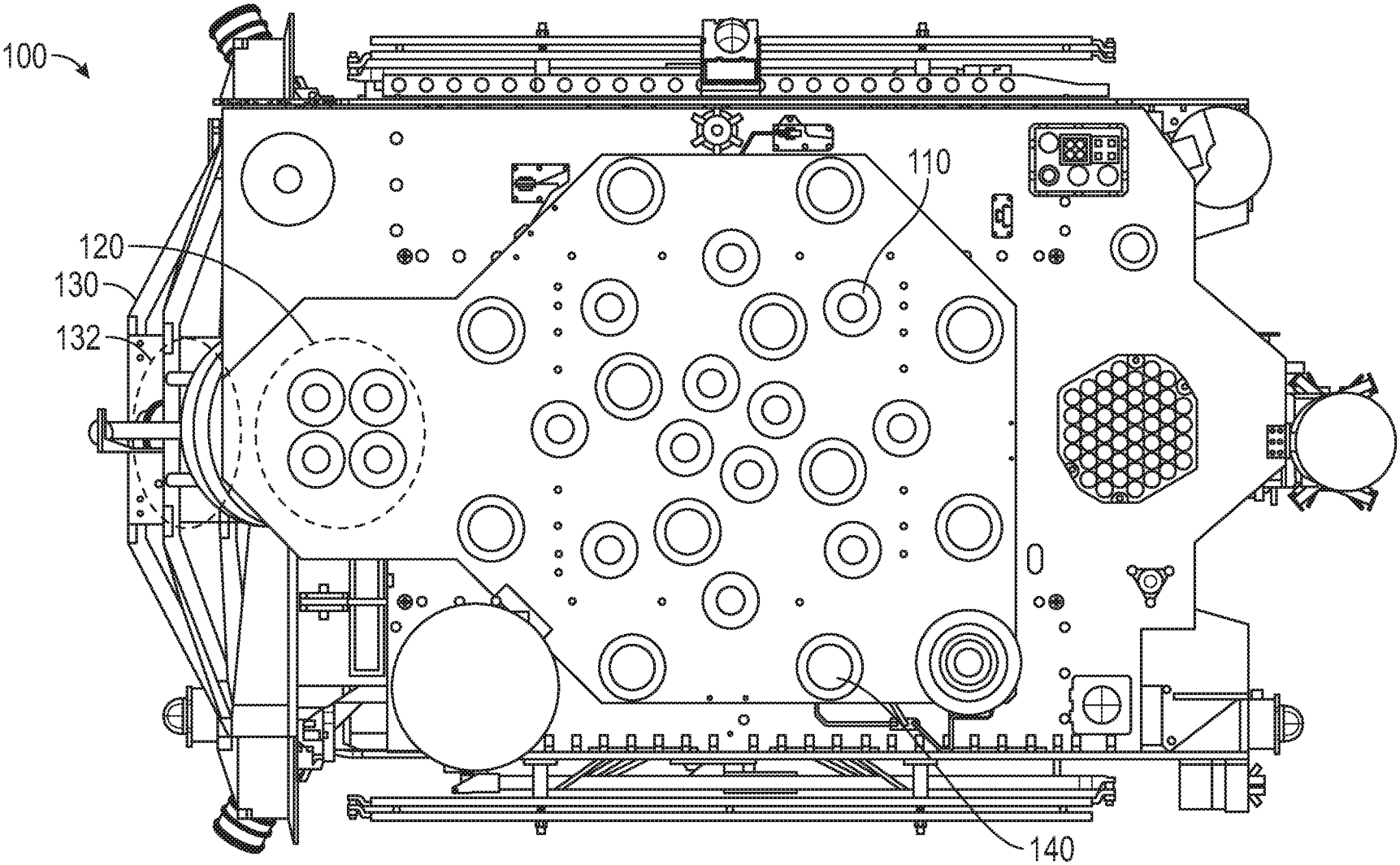
FIG. 1 (Prior Art)
FIG. 1 is a conceptual diagram illustrating an example of a global positioning system (GPS) spacecraft nadir antenna deck and corresponding regional military protection (RMP), earth coverage (EC), military earth coverage (MEC) and ultra-high frequency (UHF) crosslink antennas.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

According to some aspects of the subject technology, methods and configuration are disclosed for providing a global positioning system (GPS) antenna payload configuration for enhanced positioning, navigation and timing (PNT) accuracy and reduced high power risk. The GPS antenna payload configuration of the subject technology can reduce the PNT error and the risk for multipaction and passive intermodulation (PIM). Multipaction is an electron resonance effect that can occur when Radio Frequency (RF) fields accelerate electrons in a vacuum and cause them to impact with a surface, which depending on its energy, release one or more electrons into the vacuum. PIM can occur in passive devices (e.g., cables, antennas etc.) subjected to two or more high-power tones. The high-power tones can mix at device nonlinearities such as junctions of dissimilar metals or metal-oxide junctions, such as loose corroded connectors.

A GPS navigation array is based on advanced short backfire antennas (A-SBFAs), as described in the U.S. patent application Ser. No. 14/715,500, entitled "High Efficiency Short Backfire Antenna Using Anisotropic Impedance Walls," filed May 18, 2015, incorporated by reference herein. The GPS navigation array is oriented above the center of gravity (CG), combined with a UHF crosslink antenna, which has an offset on the bus (e.g. deployed) or alternatively a Ka-band crosslink array (as described in U.S. patent application Ser. No. 15/993,407, entitled "Combined Crosslink and Comm Link Phased Array for Satellite Applications," filed May 30, 2018, incorporated by reference herein. Orienting all of the three L-band antennas above the CG results in the best possible PNT accuracy by minimizing L-band phase center movement of the EC and RMP signals during a yaw turn and relative movement caused by the satellite traversing a user on the surface of the earth as opposed to an L-band antenna that is offset from the CG and of separate apertures. This not only improves accuracy by minimizing the uncorrelated error between signals (e.g., variation of group delay and inter-signal variation) on the same and different frequencies, but also negates the need to broadcast messages to users to account for the offset. Implementing the RMP antenna as an array spreads the power over many elements and greatly reduces multipaction and PIM risks. An array also offers multiple beams covering multiple areas of operations (AOs) to meet future customer needs. Replacing helix antennas with A-SBFAs having high power capability can significantly reduce the high power risk for the EC and MEC antennas, even though the power through the antenna is increased. Also, in contrast to helix antennas where the phase and group delay center moves along the helix with frequency, the A-SBFA has a nearly constant phase and group delay center with frequency which further reduces PNT error over the earth field of view. And finally, generating EC beams from a single A-SBFA or small array can avoid the suck-outs (nulls) toward the SSV.

FIG. 1 is a conceptual diagram illustrating an example of a GPS spacecraft antenna deck 100 and corresponding RMP, EC, MEC and UHF antennas. The GPS spacecraft antenna deck 100 employs three different L-band antennas, EC antennas 110, MEC antennas 120 and an RMP reflector dish antenna 130 (stowed view). The GPS spacecraft antenna deck 100 may also include UHF antennas 140. The EC antennas 110 may include a number (e.g., 12) of elements, which are mounted on a side (e.g., an earth facing side) of the GPS spacecraft 100 and interleaved with UHF antennas 140 (e.g., UHF cross-link antennas). The MEC antennas 120 are mounted on end sections of the same antenna deck and can include, for example, 4 elements. The RMP reflector dish antenna 130 is mounted (shown stowed) on a front face of the GPS spacecraft 100 and are fed through feed RMP antenna feed elements (e.g., 4 elements) 132. The EC antennas 110, the MEC antennas 120, and the RMP reflector dish antenna 130 can have separate phase and group delay centers, which may result in PNT errors when not suitably compensated, for example, during a regular spacecraft yaw orbital maneuvers, the phase and group delay centers of these antennas can rotate about the EC phase center create an additional source of PNT errors.

The EC, MEC and RMP antennas can use GPS helix antenna arrays to transmit substantially high average CW powers, which make them susceptible to high-power multipaction creating single-point failure risks. The EC antenna can be particularly vulnerable to multipaction due to higher powers. The subject technology mitigates this problem by replacing the EC helix array by either an A-SBFA which can handle high power or a small array, for example, a 7-element patch array, where the power from each element are combined spatially. The subject technology also implements the RMP antenna as an array to spread the power over many elements to greatly reduce multipaction and PIM risks. The close proximity of the EC and MEC antennas to the UHF antennas can increase the risk for PIM in the antennas and surrounding structure due to high signal strength from both UHF and L-band signals. The subject technology mitigates this problem by either deploying the UHF antenna away from the L-band antennas or by using a crosslink antenna at a much higher frequency, e.g., Ka-band. Further, transmitted signal power to geosynchronous satellites can be diminished by the angular suck-outs (nulls) toward the SSV of the L1 and/or L2 patterns of the GPS EC antenna (e.g., about ±23.5° and/or) ±26°. The subject technology mitigates this problem by using a small EC antenna with null width out to about ±35° which improves SSV signal availability. And finally, in the prior art L-band antennas the EC, MEC and RMP antennas have different phase and group delay centers, resulting in PNT error. The subject technology mitigates this problem by orienting all of the three L-band antennas above the CG of the spacecraft to achieve the highest possible PNT accuracy, which eliminates, for example, L-band phase center movement of the EC, MEC and RMP signals during a yaw turn of the GPS spacecraft 100. This can improve accuracy by minimizing the uncorrelated error between signals (e.g., variation of group delay and inter-signal variation) on the same and different frequencies. The subject technology further improves uncorrelated error between signals by implementing EC and RMP antenna elements with constant phase and group delay center over frequency.

Figure 2A:
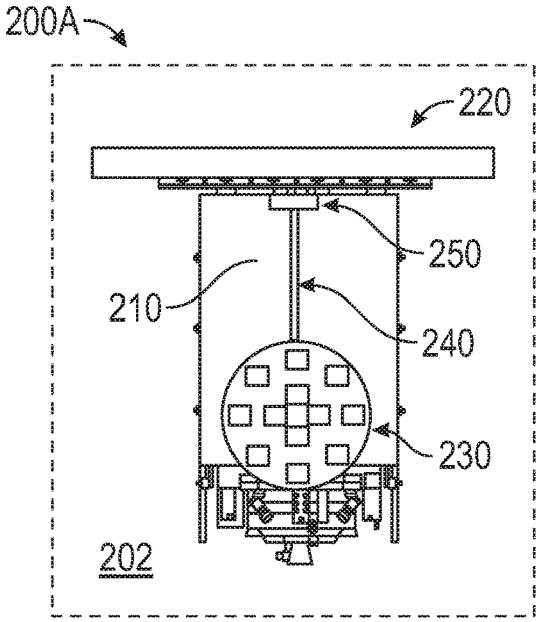
FIG. 2A is a conceptual diagram illustrating a first side view of an example of a GPS spacecraft and RMP, EC, MEC and UHF antennas, according to certain aspects of the disclosure.

FIG. 2A is a conceptual diagram illustrating a first side view 200A of an example of a GPS spacecraft 202 and RMP, EC, MEC and UHF antennas, according to certain aspects of the disclosure. The first side view 200A of the GPS spacecraft 202 shows L-band antenna arrays a bus 210, an L-band antenna array 220, a stowed UHF antenna array 230 (e.g., a cross-link antenna array) and a boom 240 including RF cables for UHF antenna array 230 deployment. The boom 240 is linked to the bus 210 through a hinge 250 that allows deployment of the UHF antenna array 230. The L-band antenna array 220 includes RMP, EC and MEC antennas and is mounted on the nadir antenna deck above the CG of the GPS spacecraft 202. This is to reduce L-band phase center movement of the EC, MEC and RMP signals during a yaw turn of the GPS spacecraft 202 and relative movement caused by the GPS spacecraft 202 orbiting the earth. The UHF antenna array 230 are mounted on a side of the GPS spacecraft 202 and sufficiently far from the L-band antenna array 220 to drastically reduce the risk for PIM in the EC and MEC antennas due to high signal strength from both the UHF antenna array 230 and the L-band signals from the L-band antenna array 220.

Figure 2B:
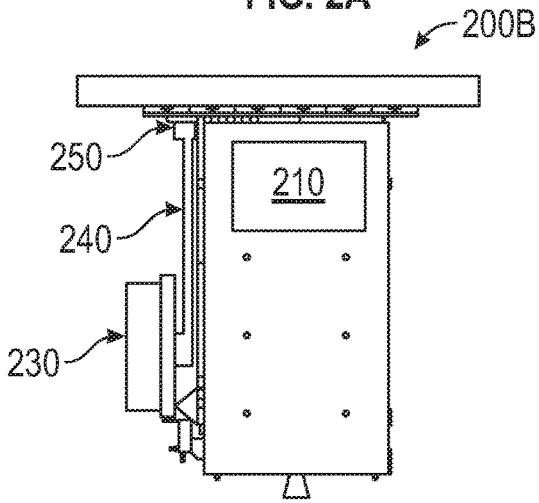
FIG. 2B is a conceptual diagram illustrating a second side view of the example GPS spacecraft and RMP, EC, MEC and UHF antennas of FIG. 2A, according to certain aspects of the disclosure.
Figure 2C:
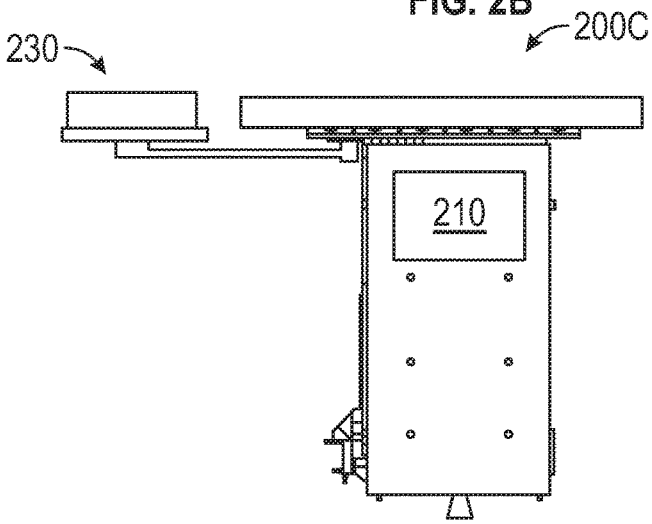
FIG. 2C is a conceptual diagram illustrating a third side view of the example GPS spacecraft and RMP, EC, MEC and UHF antennas of FIG. 2A, according to certain aspects of the disclosure.

FIG. 2B is a conceptual diagram illustrating a second side view 200B of the example GPS spacecraft and RMP, EC, MEC and UHF antennas of FIG. 2A, according to certain aspects of the disclosure. The second side view 200B shows another side of the GPS spacecraft 202, where the stowed UHF antenna array 230 is shown supported by the boom 240 and coupled by the cables to bus 210. Also seen on the second side view 200B are the sensors 250, the discussion of which is not within the scope of the subject disclosure. The L-band antennas are the focus of the current disclosure and will be discussed in more details herein. FIG. 2C is a conceptual diagram illustrating a third side view 200C of the example GPS spacecraft and RMP, EC, MEC and UHF antennas of FIG. 2A, according to certain aspects of the disclosure. The third side view 200C of the GPS spacecraft 202 is similar to the side view 200B, except that in the third side view 200C, the UHF antenna array 230 is shown to be fully deployed.

Figure 3B:
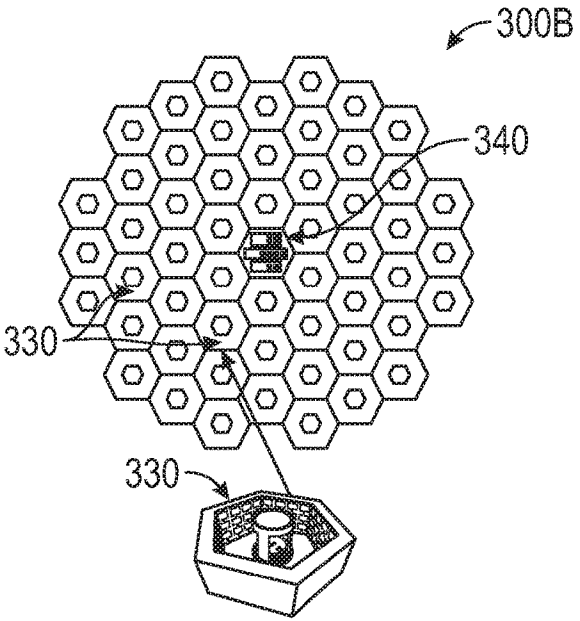
FIG. 3B is schematic diagram illustrating structural details of an antenna array including RMP antenna elements and an EC antenna element, according to certain aspects of the disclosure.
Figure 3A:
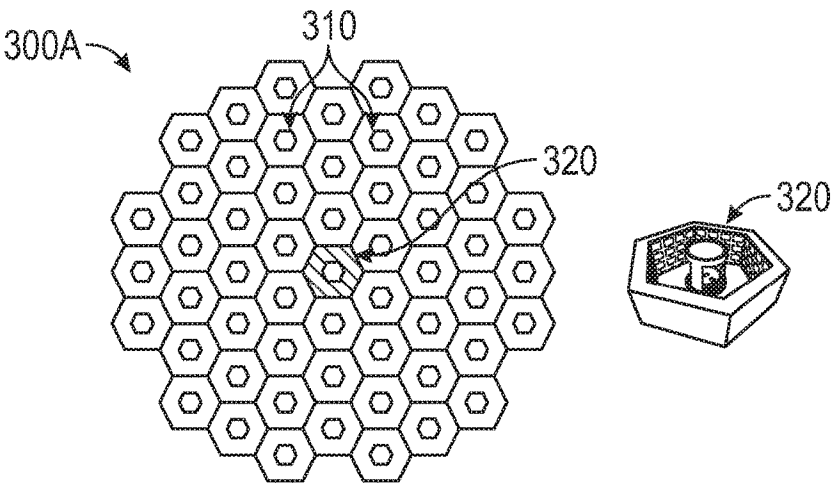
FIG. 3A is a schematic diagram illustrating structural details of an antenna array including RMP antenna elements and an EC antenna element, according to certain aspects of the disclosure.

FIG. 3A is a schematic diagram illustrating structural details of an antenna array 300A including RMP antenna elements and an EC antenna element, according to certain aspects of the disclosure. The subject EC array combines the EC and MEC signals through the same aperture. In one or more aspects, the antenna array 300A of the subject technology, as shown in FIG. 3A, includes an array of RMP antenna elements 310 having a distinct EC antenna element 320 at the center of the array. The antenna array 300A is configured to reduce (e.g., by a factor of about 50) antenna power density by distributing power among a large number of RMP antenna elements 310 distributed symmetrically around the center element. The antenna elements 310 form a multi-beam phased array. The EC antenna element 320 can be a high-power (e.g., within a range of about 700-900 W of CW) antenna element, such as a short backfire antenna. The EC antenna element 320 has a beam with a null-to-null beamwidth that is larger than approximately ±35 degrees.

FIG. 3B is schematic diagram illustrating structural details of an antenna array 300B including RMP antenna elements and an EC antenna element, according to certain aspects of the disclosure. In another aspect of the subject technology, as shown in FIG. 3B, an antenna array 300B includes a multi-beam array of RMP antenna elements 330 having an EC antenna array 340 at the center of the multi-beam array. The RMP antenna elements 330 can be implemented using an array of short backfire antenna elements, whereas the EC antenna array 340 can be a multi-element (e.g., 7-element) EC antenna array 340.

Figure 3C:
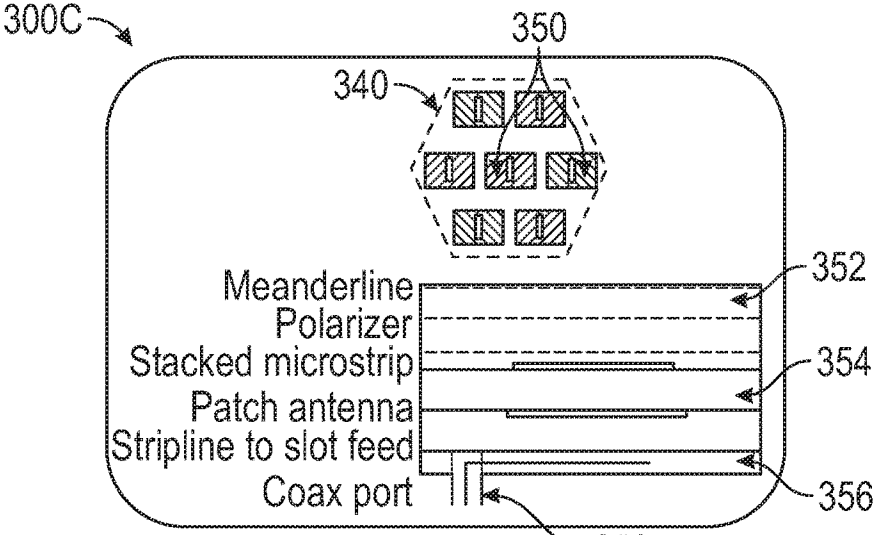
FIG. 3C is a schematic diagram illustrating structural details of an antenna element of a multielement antenna array, according to certain aspects of the disclosure.

FIG. 3C is a schematic diagram illustrating structural details of an antenna element 350 of a multielement antenna array, according to certain aspects of the disclosure. An example structure of each antenna element 350 of the multi-element array 340 is shown in the schematic diagram 300C. Each element 350 of the multi-element array 340 has a multilayer structure and includes a meanderline polarizer layer 352, a stacked microstrip patch antenna layer 354 and a stripline to slot feed layer 356 that is connected to a coaxial cable port 358.

Figure 3E:
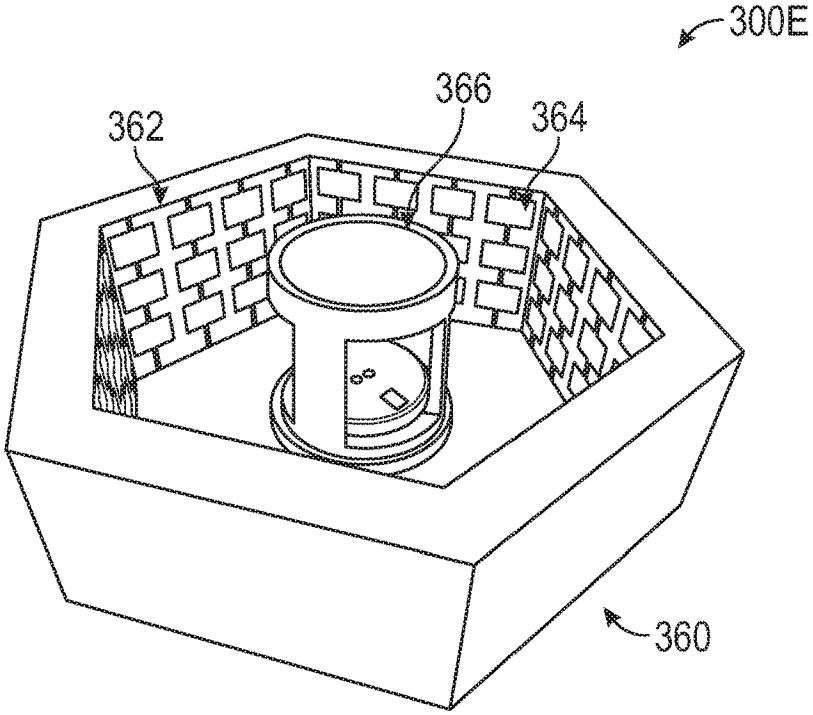
FIG. 3E is a schematic diagram illustrating structural details of a short backfire antenna element, according to certain aspects of the disclosure.
Figure 3D:
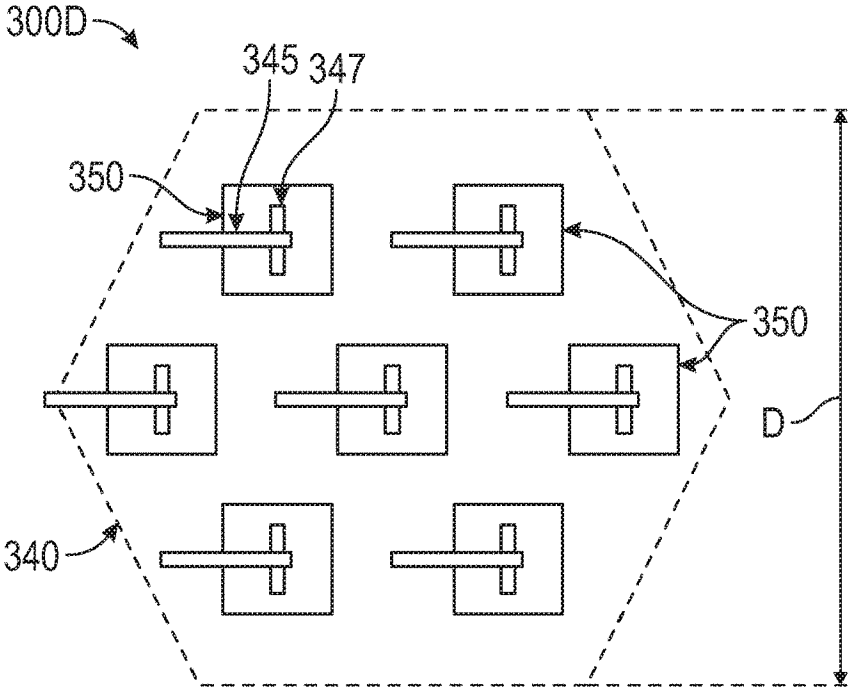
FIG. 3D is a schematic diagram illustrating further structural details of an antenna element of a multielement antenna array, according to certain aspects of the disclosure.

FIG. 3D is a schematic diagram illustrating further structural details of an antenna element of a multielement antenna array, according to certain aspects of the disclosure. Further structural details of the antenna element 350 is shown in the schematic diagram 300D of FIG. 3D. Each antenna element 350 is shown to have a feed stripline 345 and a slot feed 347. The feed stripline 345 could alternatively be implemented as a microstrip line. In one or more implementations, a dimension D of the multi-element array 340 (for L1 band) can be approximately 15 inches, which is about two times a corresponding wavelength at L1 band.

FIG. 3E is a schematic diagram illustrating structural details of a short backfire antenna element, according to certain aspects of the disclosure. FIG. 3E show a diagram 300E of an example of a short backfire antenna element 360. The short backfire antenna element 360 includes a dielectric wall 362, a hard electromagnetic (EM) surface 364 and a feed structure 366. The hard EM surface 364 can be implemented as a metamaterial with metal features on a thin dielectric liner, for example Kapton, and a foam spacer between the back of the Kapton layer and the metal wall. The feed structure 366 can include, for example, a sub-reflector, and one or more microstrip patches, as further described in the U.S. patent application Ser. No. 14/715,500, incorporated by reference herein. The aperture diameter between parallel walls can be approximately 15 inches.

Figure 4:
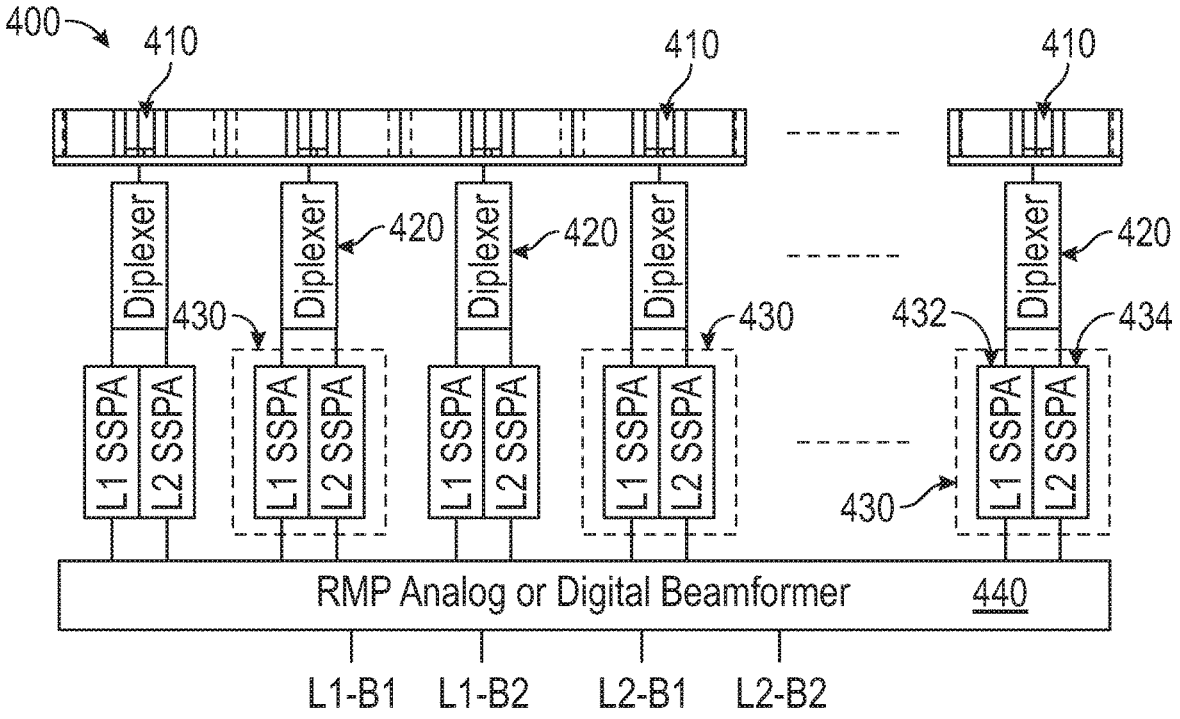
FIG. 4 is schematic diagrams illustrating an example RMP payload configuration for reduced PNT error, according to certain aspects of the disclosure.

FIG. 4 is a schematic diagram illustrating an example cross-section of an RMP payload configuration 400 for reduced PNT error, according to certain aspects of the disclosure. In the example RMP payload configuration 400, the RMP antenna elements 410 are similar to RMP antenna elements 310 of FIG. 3A. Each RMP antenna elements 410 is connected to a diplexer 420 that combines output signals of a pair of power amplifiers (PAs) 430. Each pair of PAs 430 can include an L1-band PA 432 such as a solid state PA (SSPA) and an L2-band SSPA 434. The input signals to the pair of PAs 430 are provided by an RMP analog or digital beamformer 440, which on the input receives a number of L1-band and L2-band beams (e.g., two L1 beams: L1-B1, L1-B2 and two L2 beams: L2-B1 and L2-B2). The example RMP payload configuration 400, distributes power among a number of RMP antenna elements, and the RMP analog or digital beamformer 440 suitably distributes the combined signals from the L1-band and L2-band beams into a number of L1-L2 signal pairs to feed the multiple pairs of SSPAs 430.

Figure 5A:
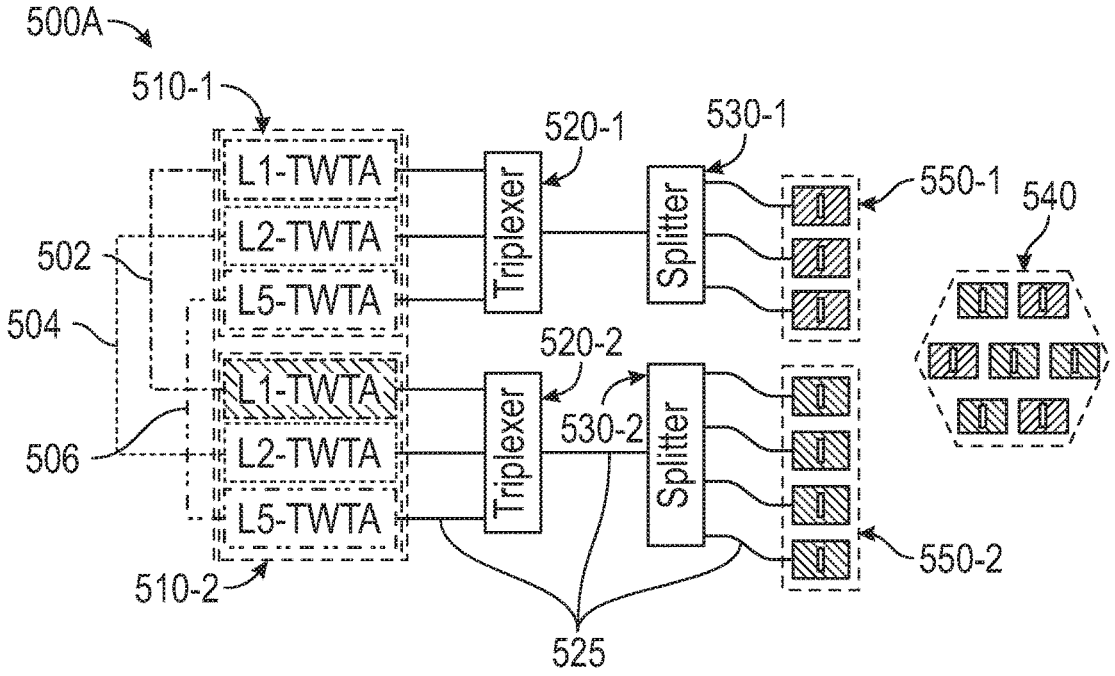
FIG. 5A is a schematic diagram illustrating an example of an EC payload configuration for reduced PNT error, according to certain aspects of the disclosure.

FIG. 5A is a schematic diagram illustrating an example of an EC payload configuration 500A for reduced PNT error and reduced power handling risk, according to certain aspects of the disclosure. The example configuration 500A of FIG. 5A includes two groups 510-1 and 510-2 of traveling wave tube amplifiers (TWTAs), frequency multiplexers (e.g., triplexers) 520-1 and 520-2, power splitters 530-1 and 530-2 and two groups of EC antenna elements 550-1 and 550-2, which are parts of a multiple- (e.g., 7) antenna EC antenna array 540. The EC antenna array 540 is similar to the EC antenna arrays 340 of FIGS. 3C and 3D. The signal from the two groups 510-1 and 510-2 of traveling wave tube amplifiers (TWTAs) all combine spatially after being radiated from the EC array 540, thereby reducing the power density in the antenna.

In the example configuration 500A, the encoded signals include civil and military codes (L1-band) signal 502 (hereinafter "signal 502"), civil and military codes (L2-band) signal 504 (hereinafter "signal 504") and civil codes (L5-band) signal 506 (hereinafter "signal 506"). The signals 502, 504 and 506 are amplified by the two groups 510-1 and 510-2 of TWTAs. Each of the groups 510-1 and 510-2 of TWTAs include an L1-, an L2- and an L5-band TWTA. The output of each of the groups 510-1 and 510-2 of TWTAs is at a specific frequency band and are transmitted, via cables 525, to the frequency triplexers 520-1 and 520-2 for combining the three frequencies (L1-, L2- and L5-band). The output of the triplexers 520-1 and 520-2 are transmitted, via cables 525, to the power splitters 530-1 and 530-2. The power splitter 530-1 splits the power of the first combined signal from the triplexer 520-1 into three components for delivery, via cables 525, to three EC antenna elements of the first group of EC antenna elements 550-1. The power splitter 530-2 splits the power of the second combined signal from the triplexer 520-2 into four components for delivery, via cables 525, to four EC antenna elements of the second group of EC antenna elements 550-2. The relative power between the two groups 510-1 and 510-2 of TWTAs is selected such that the 7 individual antenna elements are the same.

Figure 5B:
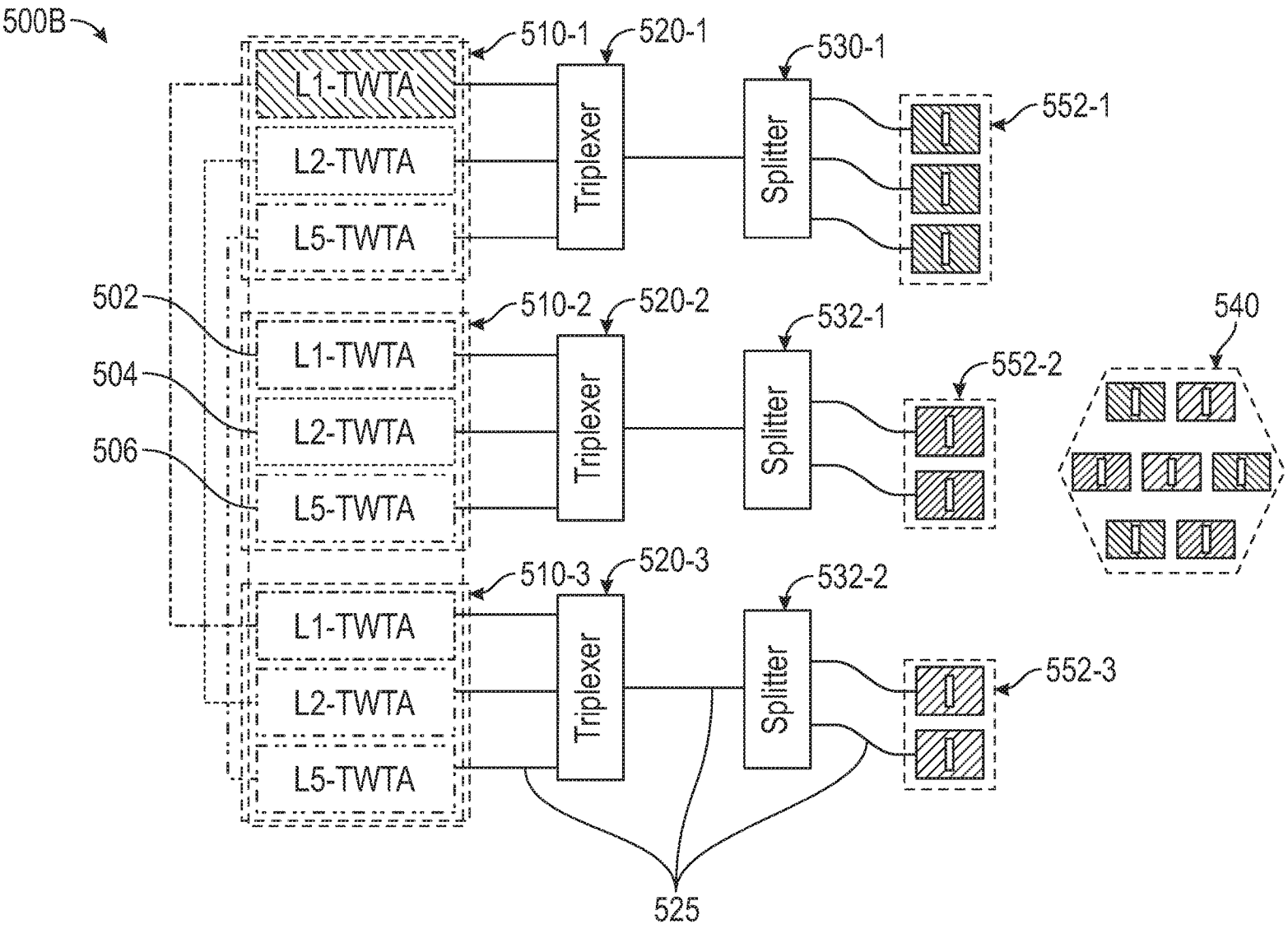
FIG. 5B is a schematic diagram illustrating an example of an EC payload configuration for reduced PNT error, according to certain aspects of the disclosure.

FIG. 5B is a schematic diagram illustrating an example of an EC payload configuration 500B for reduced PNT error, according to certain aspects of the disclosure. The example configuration 500B of FIG. 5B includes three groups 510-1, 510-2 and 510-3 of TWTAs, three frequency multiplexers (e.g., triplexers) 520-1, 520-2 and 520-3, three power splitters 530-1, 532-1 and 532-2 and three groups of EC antenna elements 552-1, 552-2 and 552-3, which are parts of a multiple- (e.g., 7) antenna EC antenna array 540.

In the example configuration 500B, the signal 502, 504 and 506 are amplified by the three groups 510-1, 510-2 and 510-3 of TWTAs. Each of the groups 510-1, 510-2 and 510-3 of TWTAs include an L1-, an L2- and an L5-band TWTAs. The output of each of the groups 510-1, 510-2 and 510-3 of TWTAs is at a specific frequency band and are transmitted, via cables 525, to the frequency triplexers 520-1, 520-2 and 520-3 for combining the three frequencies (L1-, L2- and L5-band). The output of the triplexers 520-1, 520-2 and 520-3 are transmitted, via cables 525, to the power splitters 530-1, 532-1 and 532-2. The power splitter 530-1 splits the power of the first combined signal from the triplexer 520-1 into three components for delivery, via cables 525, to three EC antennas of the first group of EC antenna elements 552-1. The power splitter 532-1 splits the power of the second combined signal from the triplexer 520-2 into two components for delivery, via cables 525, to two EC antennas of the second group of EC antenna elements 552-2. The power splitter 532-2 splits the power of the third combined signal from the triplexer 520-3 into two components for delivery, via cables 525, to two EC antennas of the third group of EC antenna elements 552-3. The relative power between the three groups 510-1, 510-2 and 510-3 of TWTAs is selected such that the 7 individual antenna elements are the same.

Figure 5C:
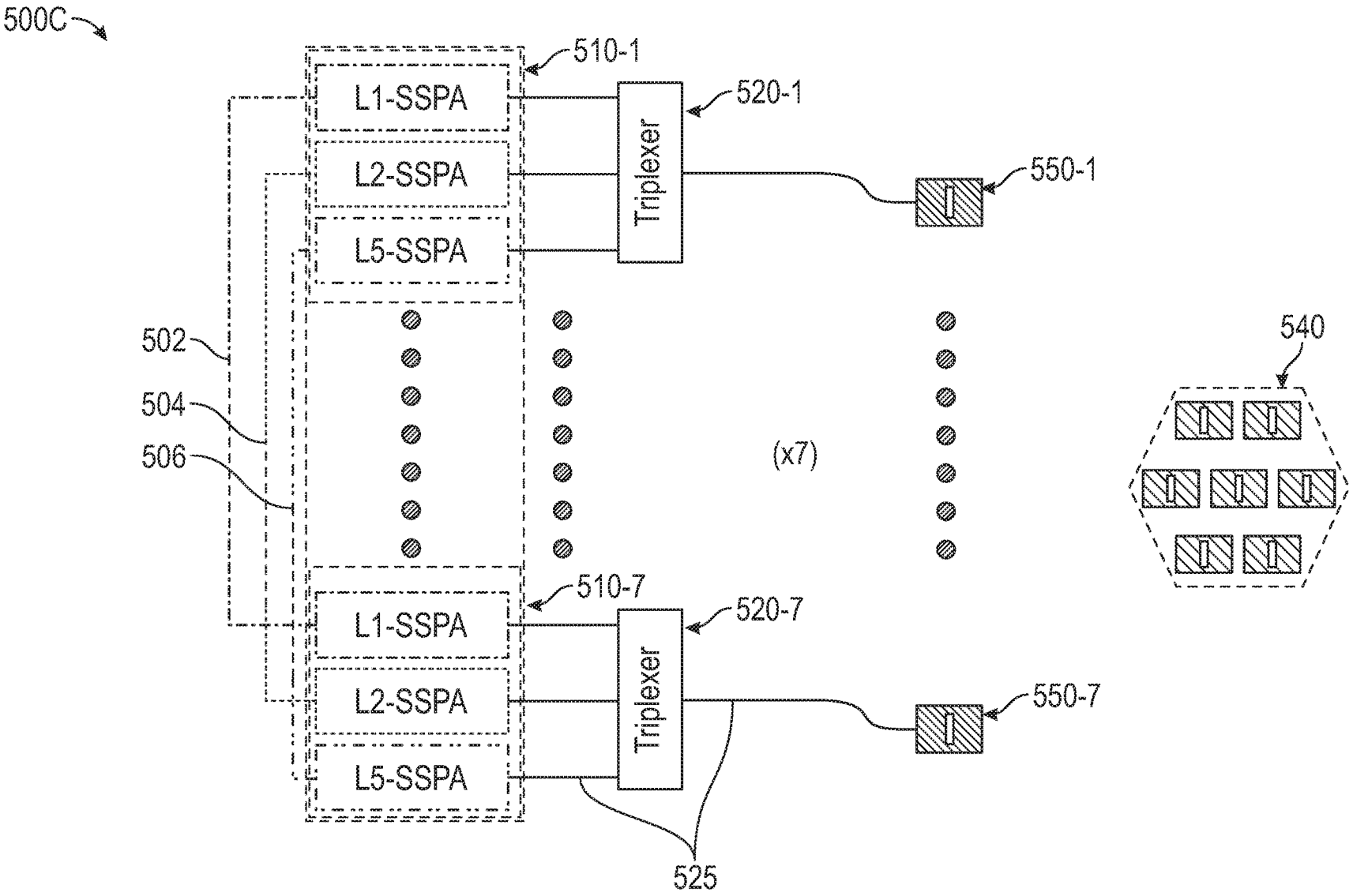
FIG. 5C is a schematic diagram illustrating an example of an EC payload configuration for reduced PNT error, according to certain aspects of the disclosure.

FIG. 5C is a schematic diagram illustrating an example of an EC payload configuration 500C for reduced PNT error, according to certain aspects of the disclosure. The example configuration 500C of FIG. 5C includes seven groups 510-1 . . . 510-7 of SSPAs and seven frequency multiplexers (e.g., triplexers) 520-1 . . . 520-7 and seven EC antenna elements 550-1 . . . 550-7, which are parts of a multiple- (e.g., 7) antenna EC antenna array 540.

In the example configuration 500C, the signal 502, 504 and 506 are amplified by the seven groups 510-1 . . . 510-7 of SSPAs. Each of the groups 510-1, 510-2 and 510-3 of SSPAs include an L1-, an L2- and an L5-band SSPAs. The output of each of the groups 510-1 . . . 510-7 of SSPAs is at a specific frequency band and are transmitted, via cables 525, to the frequency triplexers 520-1 . . . 520-7 for combining the three frequencies (L1-, L2- and L5-band). The outputs of each of the triplexers 520-1 . . . 520-7 are transmitted, via cables 525, to each of the corresponding seven EC antenna elements 550-1 . . . 550-7. The relative power between the seven groups 510-1 to 510-7 of TWTAs is uniform such that the 7 individual antenna elements are the same.

The examples of EC payload configurations 500A through 500C enable combining multiple encoded signals onboard the spacecraft (e.g., satellite) to achieve a reduced PNT error, reduced power density along each RF path and lower power per amplifier. The EC payload configurations of the subject technology are not limited to the payload configurations 500A through 500C discussed herein and can include other ways of combining the encoded signals.

Figure 6:
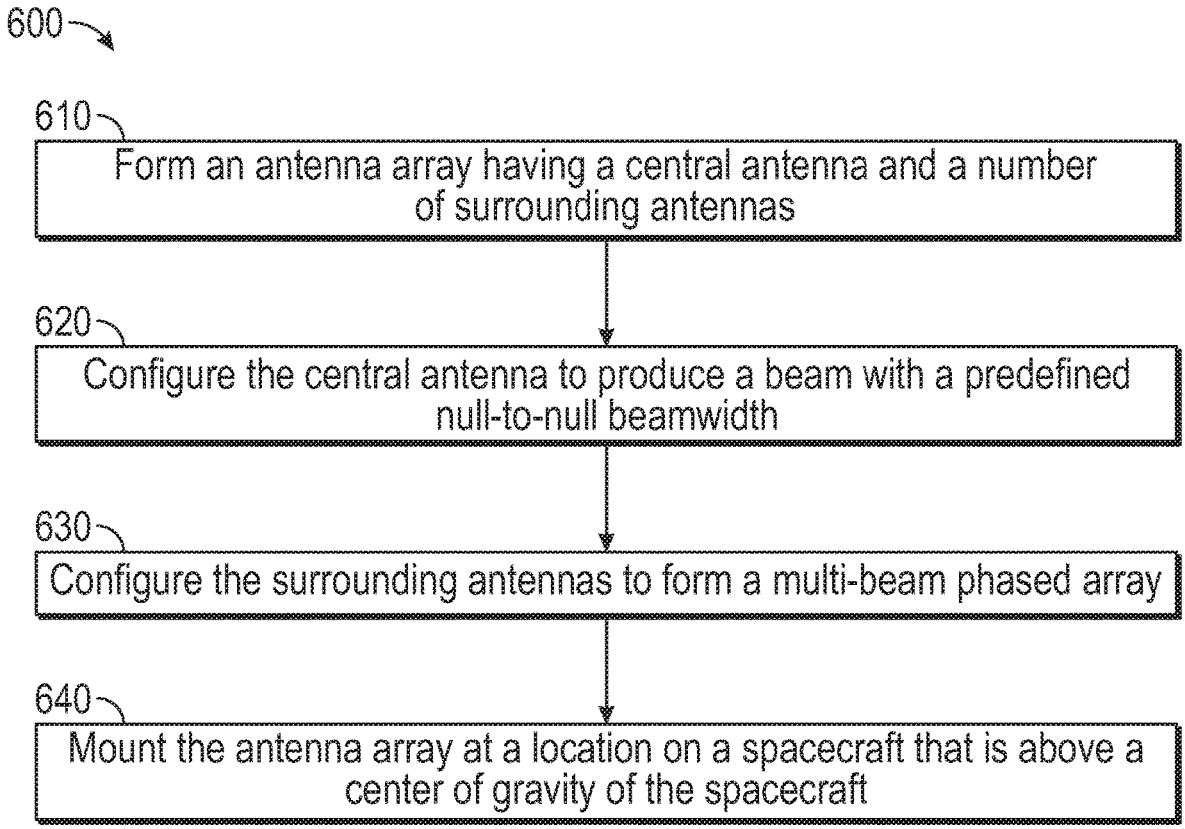
FIG. 6 is a flow diagram illustrating an example method for providing GPS antenna array with EC and RMP antennas, according to certain aspects of the disclosure.

FIG. 6 is a flow diagram illustrating an example method 600 for providing GPS antenna array with EC and RMP antennas, according to certain aspects of the disclosure. The method 600 includes forming an antenna array (e.g., 300A and 300B of FIGS. 3A and 3B) having a central antenna array (e.g., 320 and 340 of FIGS. 3A and 3B) and a number of surrounding antennas (e.g., 310 and 330 of FIGS. 3A and 3B) (610). The method 600 further includes configuring the central antenna array to produce a beam with a predefined null-to-null beamwidth (e.g., about ±35 degrees, as shown in 700-1 of FIG. 7) (620). The method 600 further includes configuring the surrounding antennas to form a multi-beam phased array (e.g., 400 of FIG. 4) (630). The antenna array is mounted at a location on a spacecraft that is above the center of gravity of the spacecraft (see, e.g., 220 of FIGS. 2A and 2B) (640).

Figure 7A:
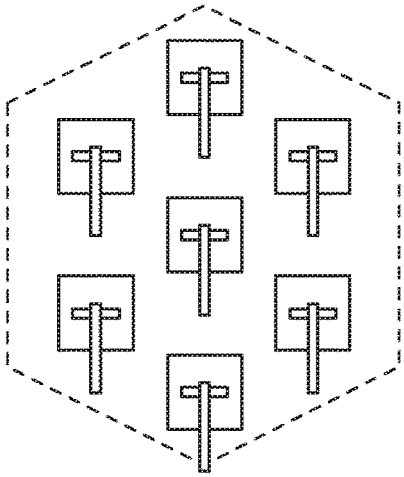
FIG. 7A shows a chart illustrating an analytic result of E and H plane antenna patterns for an L1 band of an EC antenna, according to certain aspects of the disclosure.
Figure 7A:
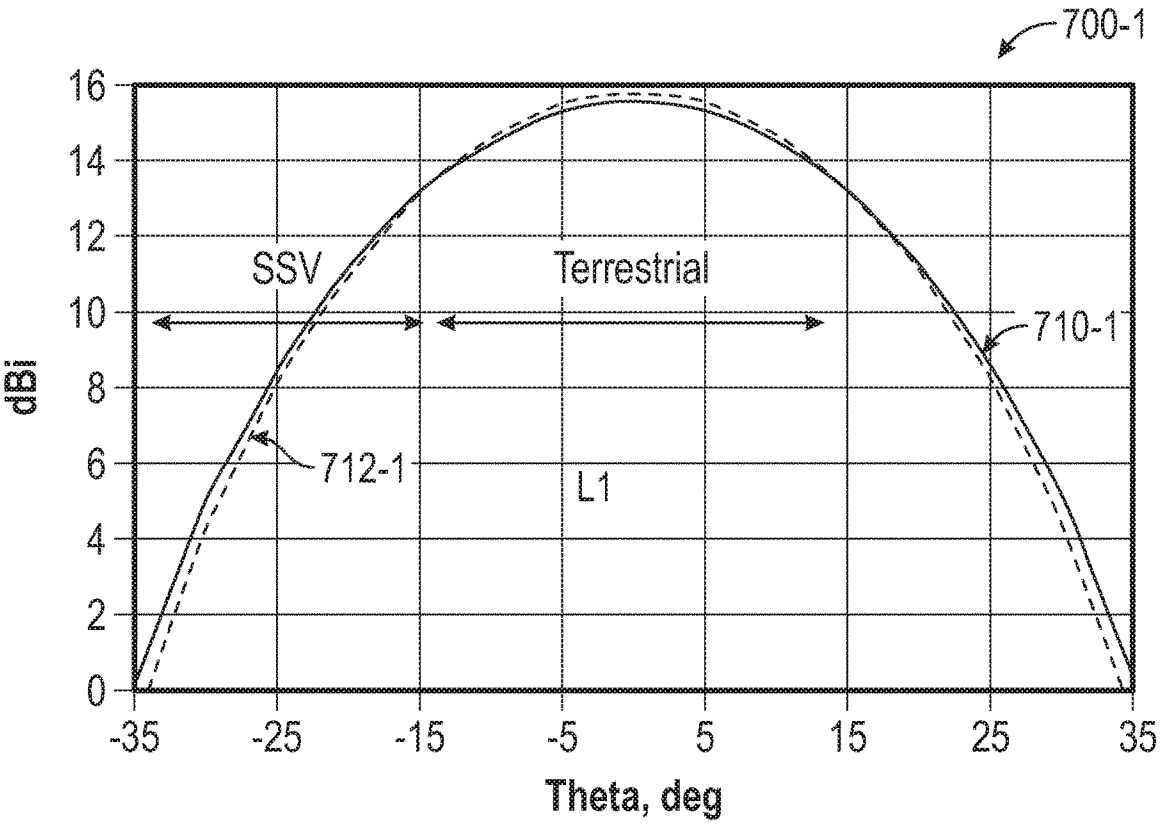

FIG. 7A shows a chart 700-1 illustrating an analytic result of E and H plane antenna patterns for an L1 band of an EC antenna, according to certain aspects of the disclosure. The chart 700-1 depicts E and H plane antenna patterns for the L1 band. In this chart, a plot 710-1 corresponds to the H-plane, and a plot 712-1 corresponds to the E-plane. The antenna patterns are not seen to have any nulls in the SSV.

Figure 7B:
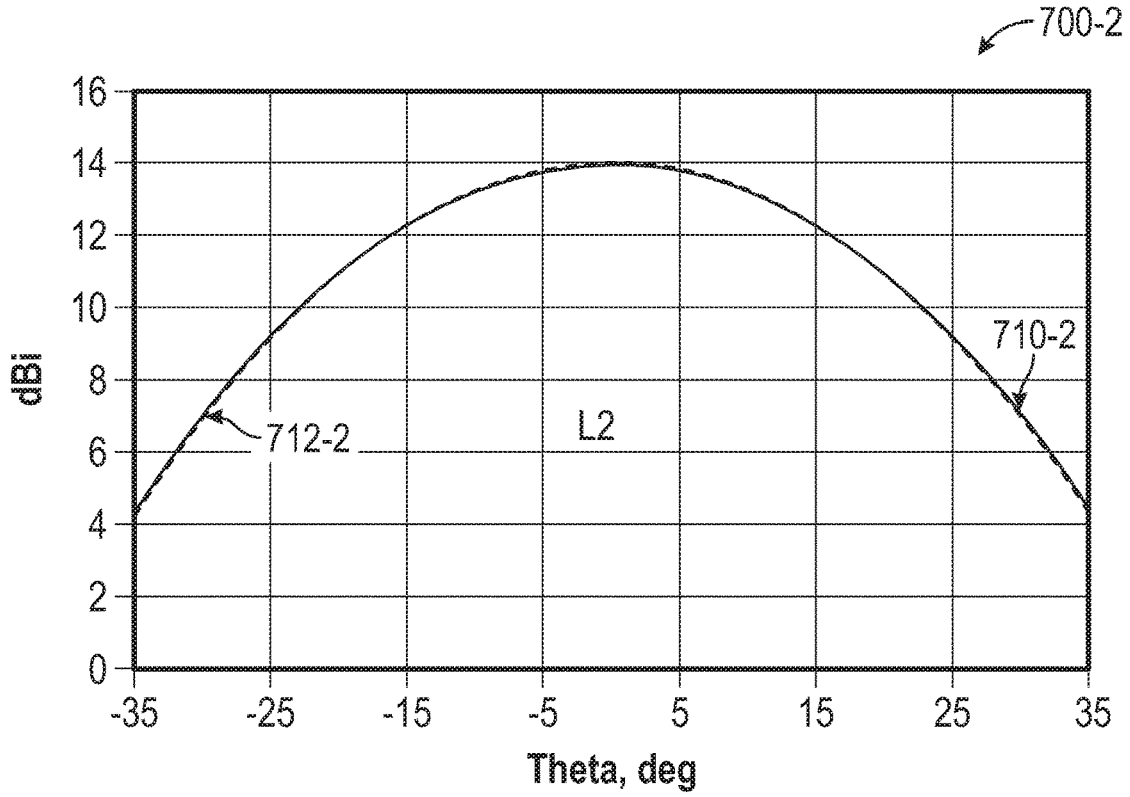
FIG. 7B shows a chart illustrating an analytic result of E and H plane antenna patterns for an L2 band of an EC antenna, according to certain aspects of the disclosure.

FIG. 7B shows a chart 700-2 illustrating an analytic result of E and H plane antenna patterns for an L2 band of an EC antenna, according to certain aspects of the disclosure. The chart 700-2 depicts E and H plane antenna patterns for the L2 band. In this chart, a plot 710-2 corresponds to the H-plane, and a plot 712-2 corresponds to the E-plane. The antenna patterns are not seen to have any nulls in the SSV.

Figure 7C:
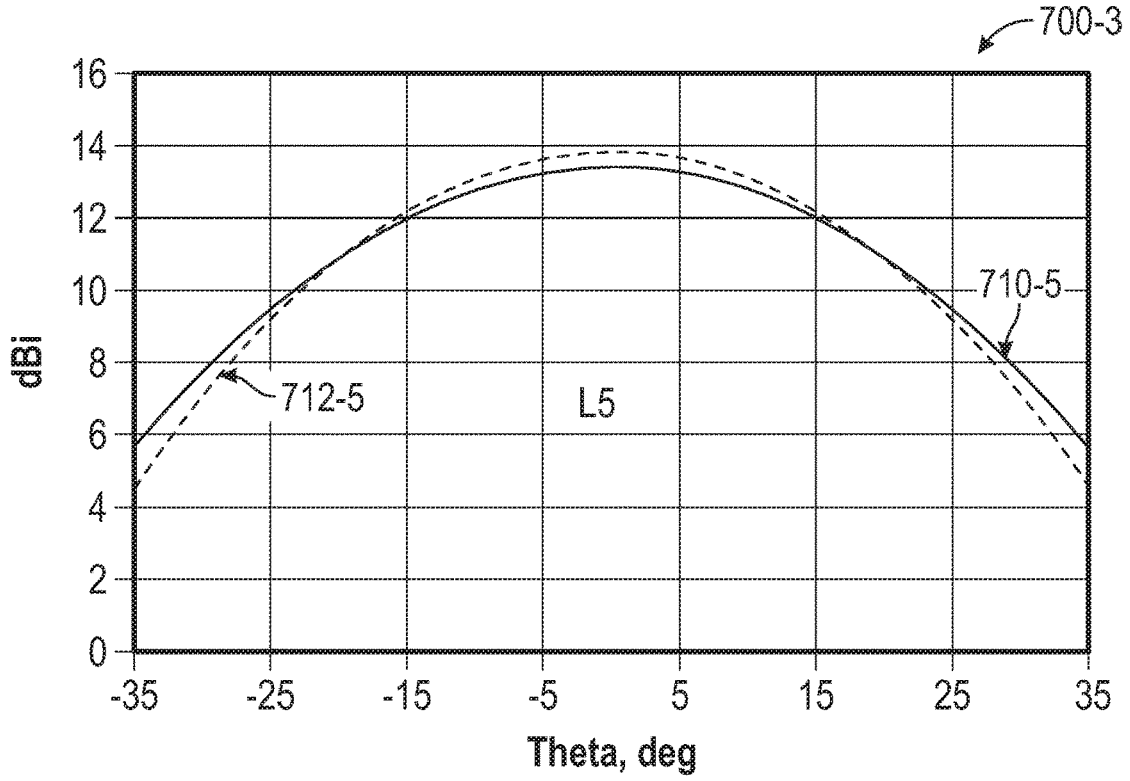
FIG. 7C shows a chart illustrating an analytic result of E and H plane antenna patterns for an L5 band of an EC antenna, according to certain aspects of the disclosure.

FIG. 7C shows a chart 700-3 illustrating an analytic result of E and H plane antenna patterns for an L5 band of an EC antenna, according to certain aspects of the disclosure. The chart 700-3 depicts E and H plane antenna patterns for the L5 band. In this chart, a plot 710-5 corresponds to the H-plane, and a plot 712-5 corresponds to the E-plane. The antenna patterns are not seen to have any nulls in the SSV.

Figure 7D:
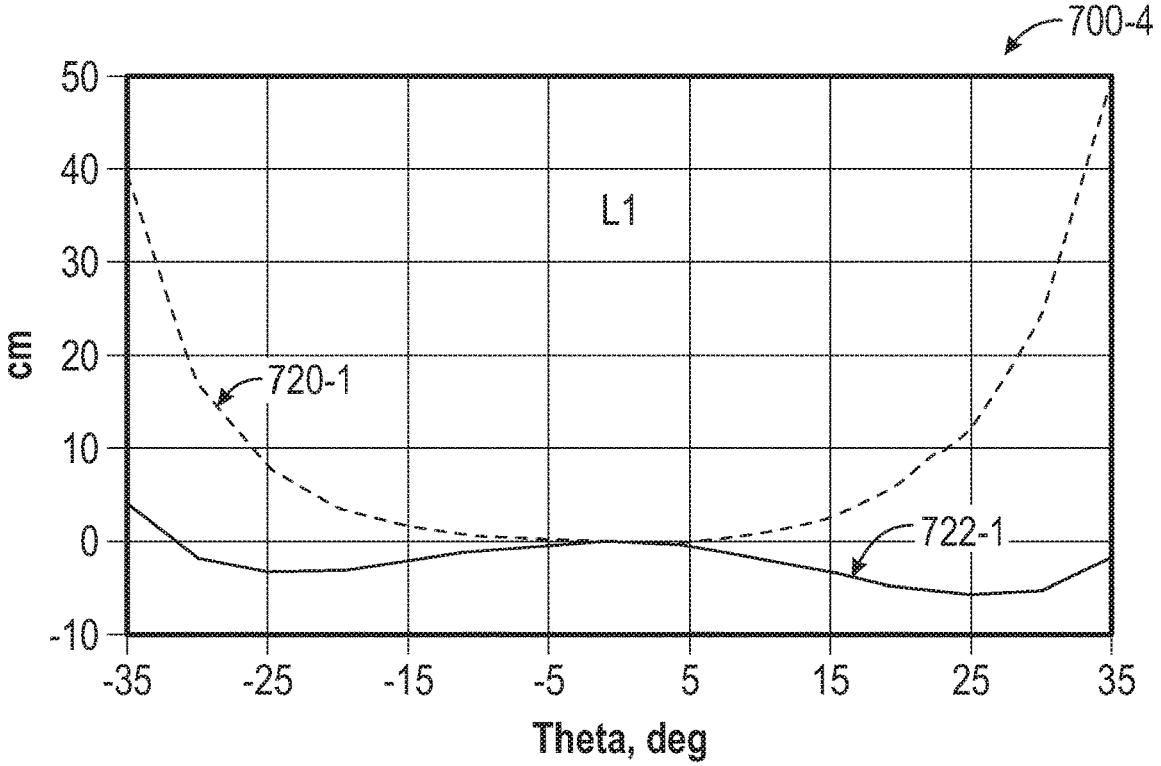
FIG. 7D shows a chart illustrating an analytic result of E and H plane group delays for an L1 band of an EC antenna, according to certain aspects of the disclosure.

FIG. 7D shows a chart 700-4 illustrating an analytic result of E and H plane group delays for an L1 band of an EC antenna, according to certain aspects of the disclosure. The chart 700-4 depicts E and H plane group delays (in cm) for an L1 band. In the charts 700-4, a plot 720-1 corresponds to the H-plane, and a plot 722-1 corresponds to the E-plane.

Figure 7E:
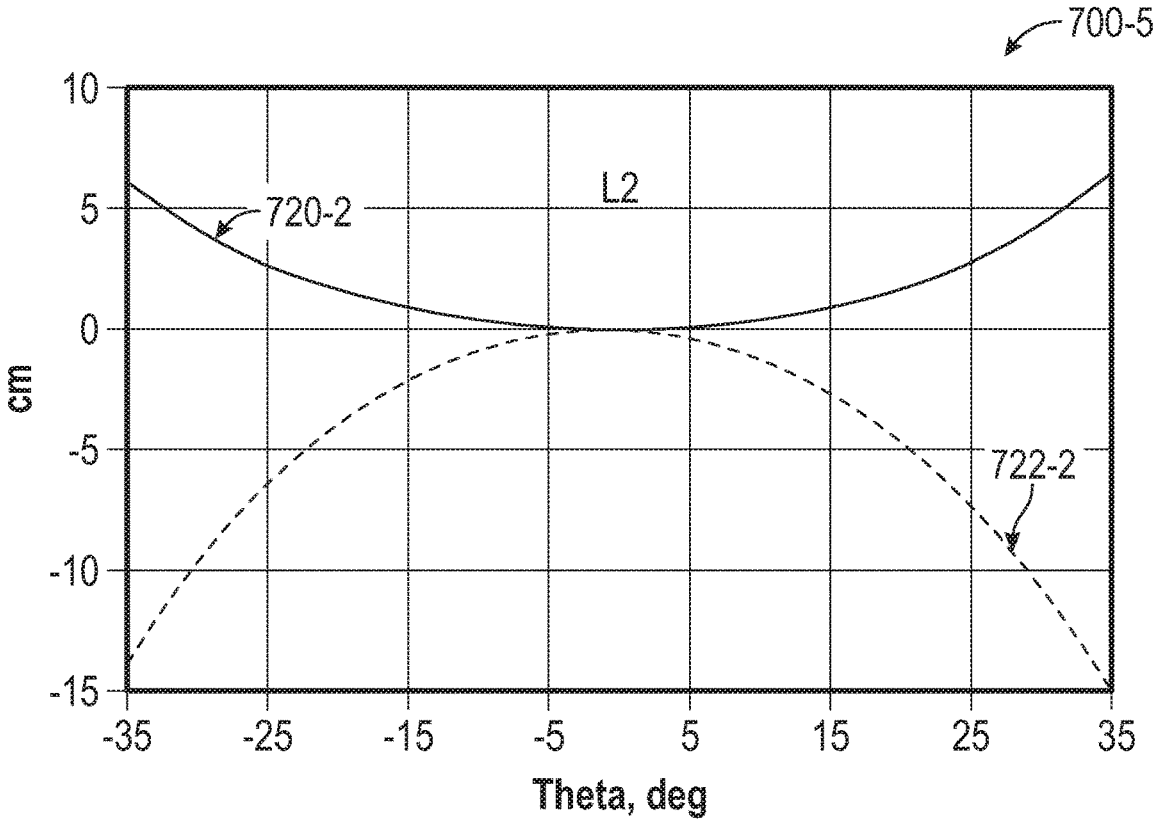
FIG. 7E shows a chart illustrating an analytic result of E and H plane group delays for an L2 band of an EC antenna, according to certain aspects of the disclosure.

FIG. 7E shows a chart 700-5 illustrating an analytic result of E and H plane group delays for an L2 band of an EC antenna, according to certain aspects of the disclosure. The chart 700-5 depict E and H plane group delays (in cm) for an L2 band. In the charts 700-5, a plot 720-2 corresponds to the H-plane, and a plot 722-2 corresponds to the E-plane.

Figure 7F:
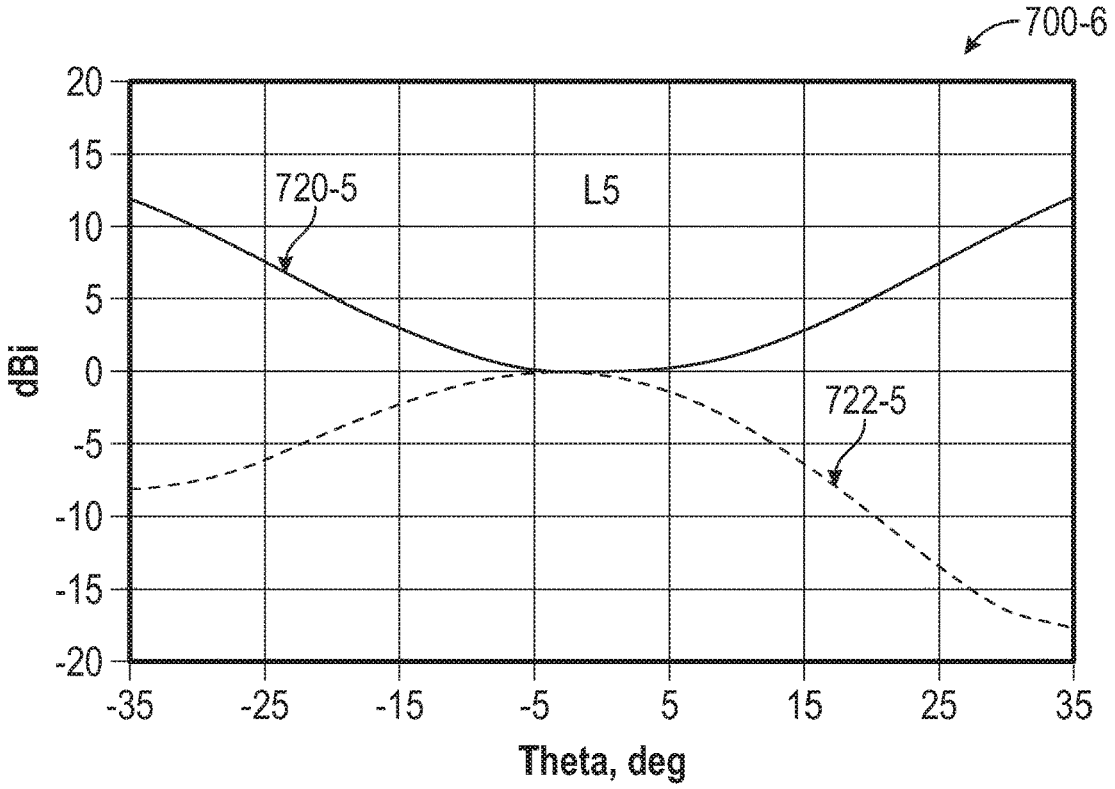
FIG. 7F shows a chart illustrating an analytic result of E and H plane group delays for an L5 band of an EC antenna, according to certain aspects of the disclosure.

FIG. 7F shows a chart 700-6 illustrating an analytic result of E and H plane group delays for an L5 band of an EC antenna, according to certain aspects of the disclosure. The chart 700-6 depict E and H plane group delays (in cm) for the L5 band. In the charts 700-6, a plot 720-5 corresponds to the H-plane, and a plot 722-5 corresponds to the E-plane.

Figure 8:
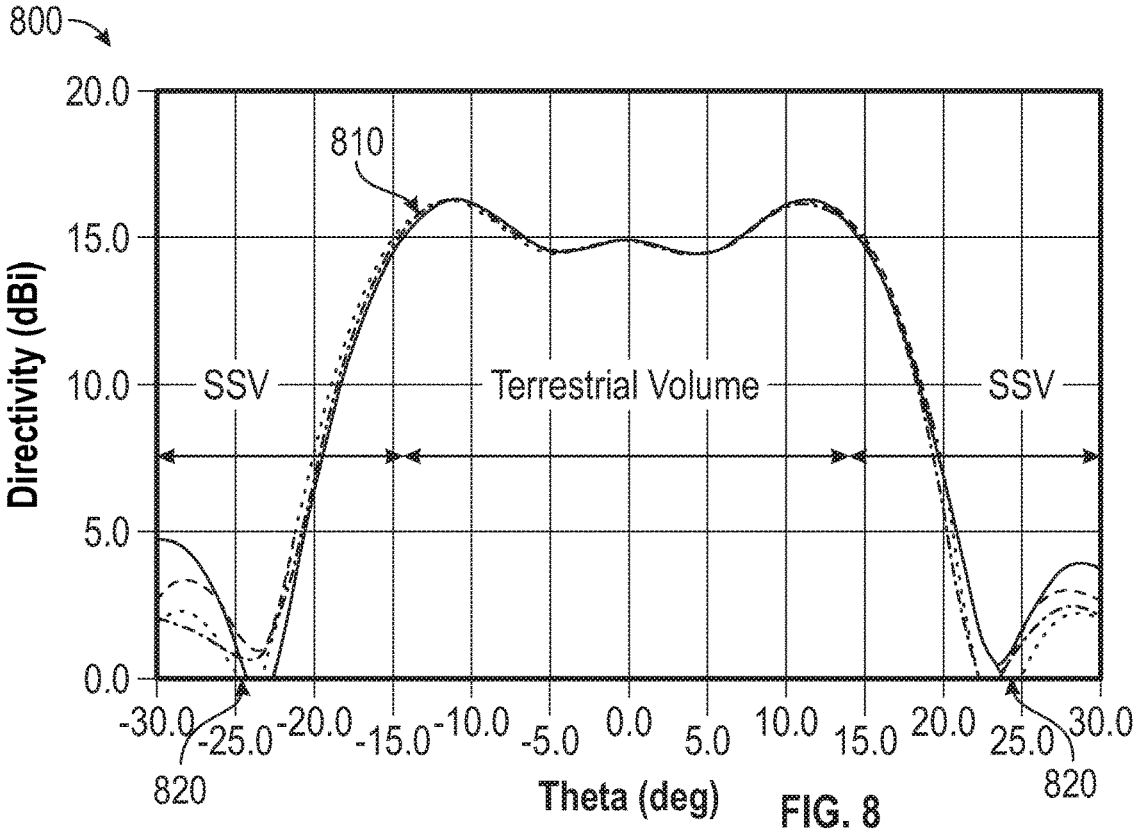
FIG. 8 (Prior Art)
FIG. 8 is a chart illustrating predicted EC directivity patterns at L1 band for existing solutions.

FIG. 8 is a chart 800 illustrating predicted EC directivity patterns 810 at L1 band for existing solutions. The prior art GPS EC antenna L1 and/or L2 patterns 810, shown in FIG. 8, have angular suck-outs (nulls) 820 toward the SSV at about ±23.5° and/or ±26°, which diminishes transmitted signal power to geosynchronous satellites SSV users.

In some aspects, the subject technology is related to antennas, and more particularly, to a GPS antenna payload configuration for enhanced PNT accuracy and reduced high power risk. In some aspects, the subject technology may be used in various markets, including for example and without limitation, space technology, communications systems, navigation, GPS, and advanced short backfire antenna markets.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

As used in this specification and any claims of this application, the terms "base station", "receiver", "computer", "server", "processor", and "memory" all refer to electronic or other technological devices. These terms exclude people or groups of people. For the purposes of the specification, the terms "display" or "displaying" means displaying on an electronic device.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. An antenna array comprising:

a first antenna element; and a plurality of second antenna elements, wherein:

the antenna array is placed at a location on a spacecraft that is above a center of gravity of the spacecraft, the first antenna element is located at a center of the antenna array and is surrounded by the plurality of second antenna elements, the first antenna element is configured to produce a beam with a predefined null-to-null beamwidth, and the plurality of second antenna elements are symmetrically configured to form an electronically-steerable multi-beam phased array.

2. The antenna array of claim 1, wherein the first antenna element and the plurality of second antenna elements are configured to operate at multiple encoded signals at a same frequency, and wherein the first antenna element and the plurality of second antenna elements are used in combination or separately.

3. The antenna array of claim 2, wherein the multiple encoded signals are combined by a processor of the spacecraft.

4. The antenna array of claim 3, wherein the processor is configured to combine the multiple encoded signals enabling reduction of uncorrelated user range error between signals across different frequencies and signals on the same frequency.

5. The antenna array of claim 1, wherein the antenna array comprises earth coverage (EC) antennas with civil and military codes, and spot-beam antennas, and the first antenna element comprises a high-power EC antenna element capable of handling up to about 700 W, and wherein the high-power EC antenna comprises a short backfire antenna.

6. The antenna array of claim 5, wherein the high-power EC antenna comprises a multi-element EC patch array, wherein the multi-element EC patch array comprises seven EC antenna elements, and wherein the high-power EC has a phase and a group delay center that are constant over a range of frequencies.

7. The antenna array of claim 6, wherein each antenna of the multi-element EC patch array is arranged to receive combined amplified L1, L2 and L5 signals from two or more power splitters, and wherein the two or more power splitters are configured split power of combined signals received from two or more frequency triplexers are arranged to combine amplified signals received from two or more groups of solid-state power amplifiers (SSPAs).

8. The antenna array of claim 7, wherein the first antenna elements is configured to produce the beam with the predefined null-to-null beamwidth that is about ±35 degrees.

9. A system comprising:

an antenna array comprising a central antenna element and a plurality of symmetrically arranged surrounding antenna elements;

two or more groups of amplifiers, each group of amplifiers comprising a plurality of amplifiers configured to operate at a frequency band; and two or more frequency multiplexers, each frequency multiplexer configured to combine amplified signals from a group of amplifiers of the two or more groups of amplifiers, wherein:

the antenna array is placed at a location on a spacecraft that is above a center of gravity of the spacecraft, the central antenna element is configured to produce a beam with a predefined null-to-null beamwidth, and the plurality of surrounding antennas are configured to form a multi-beam electronically-steerable array.

10. The system of claim 9, wherein the two or more groups of amplifiers comprise traveling wave tube amplifiers (TWTAs) or solid state power amplifiers (SSPAs), and wherein each group of amplifiers includes L1, L2 and L5 amplifiers.

11. The system of claim 9, wherein the central antenna element and the plurality of surrounding antennas are configured to operate at multiple code-division multiple-access (CDMA) encoded signals at a same frequency, and wherein the multiple encoded signals are combined by a processor of the spacecraft.

12. The system of claim 9, wherein the antenna array comprises earth coverage (EC) antennas with civil and military codes, and spot-beam antennas, and the central antenna element comprises a high-power EC antenna capable of handling up to about 700 W, and wherein the high-power EC antenna comprises a short backfire antenna.

13. The system of claim 12, wherein the high-power EC antenna comprises a multi-element EC patch array, and wherein the multi-element EC patch array comprises seven EC antennas.

14. The system of claim 9, wherein the central antenna element is configured to produce the beam with the predefined null-to-null beamwidth within a range of about ±30 to ±35 degrees.

15. The system of claim 9, further comprising two or more power splitters, each power splitter configured to split signals received from a frequency multiplexer of the two or more frequency multiplexers.

16. The system of claim 15, wherein the two or more groups of amplifiers comprise three groups of amplifiers, the two or more frequency multiplexers comprise three frequency triplexers and the two or more power splitters comprises three power splitters.

17. The system of claim 9, wherein the central antenna element comprises a multi-element EC patch array, wherein the multi-element EC patch array comprises seven antenna elements, and wherein two or more groups of amplifiers comprise seven groups of amplifiers, the two or more frequency multiplexer comprise seven triplexers, and wherein each triplexer is coupled to one antenna element of the seven-element EC antenna.

18. A method of configuring a global positioning system (GPS) antenna payload, the method comprising:

forming an antenna array comprising a central antenna and a plurality of surrounding antennas;

configuring the central antenna to produce a beam with a predefined null-to-null beamwidth;

configuring the plurality of surrounding antennas to form a multi-beam electronically-steerable array; and mounting the antenna array at a location on a spacecraft that is above the center of gravity of the spacecraft.

19. The method of claim 18, further comprising configuring the central antenna and the plurality of surrounding antennas to operate at multiple encoded signals at a same frequency, and configuring a processor of the spacecraft to combine the multiple encoded signals.

20. The method of claim 19, further comprising configuring the processor of the spacecraft to enable reduction of uncorrelated user range error between signals across different EC and RMP antenna apertures and signals on the same frequency by combining the multiple encoded signals.

* * * * *